US005609511A

United States Patent [19]

Moriyama et al.

[11] Patent Number: 5,609,511

[45] Date of Patent: Mar. 11, 1997

[54] POLISHING METHOD

[75] Inventors: Shigeo Moriyama, Tama; Yoshio Kawamura, Kokubunji; Yoshio Homma, Hinode-machi; Kikuo Kusukawa, Fujino-machi; Takeshi Furusawa, Hachioji, all of Japan

[73] Assignee: Hitachi, Ltd., Tokyo, Japan

[21] Appl. No.: 421,247

[22] Filed: Apr. 13, 1995

[30] Foreign Application Priority Data

Apr. 14, 1994 [JP] Japan ..... 6-075625

[51] Int. Cl.[6] ..... B24B 49/00; B24B 51/00

[52] U.S. Cl. ..... 451/5; 451/8

[58] Field of Search ..... 451/5, 6, 7, 8, 451/10, 21, 41, 42, 53, 54, 55, 60, 63, 259, 283, 285, 287, 288, 289, 290, 364, 384, 397, 402

[56] References Cited

U.S. PATENT DOCUMENTS

| | | | |
|---|---|---|---|
| 3,148,129 | 9/1964 | Basseches et al. | 204/38 |
| 3,515,987 | 6/1970 | Zurbrick et al. | 324/61 |
| 5,069,002 | 12/1991 | Sandhu et al. | 451/1 |
| 5,081,421 | 1/1992 | Miller et al. | 324/671 |
| 5,099,614 | 3/1992 | Arai et al. | 451/8 |
| 5,234,868 | 8/1993 | Cote | 437/225 |
| 5,245,794 | 9/1993 | Salugsugan | 451/10 |

FOREIGN PATENT DOCUMENTS 460384 4/1991 European Pat. Off. .

*Primary Examiner*—Bruce M. Kisliuk
*Assistant Examiner*—Derris Banks
*Attorney, Agent, or Firm*—Antonelli, Terry, Stout & Kraus, LLP

[57] ABSTRACT

Disclosed is a method of polishing a thin film layer to be polished, which is formed on the surface of a substrate, by pressing the substrate on the surface of a polishing pad and relatively moving the substrate and the polishing pad, the method comprising the steps of: detecting the position of a front surface of the thin film layer to be polished using a first sensor and also detecting the position of a bottom surface of the thin film layer using a second sensor, on the way of the polishing; calculating the residual thickness of the thin film layer on the basis of the detected positions of the front and bottom surfaces of the thin film layer; and controlling the processing condition of the subsequent polishing on the basis of the calculated residual thickness of the thin film layer.

13 Claims, 12 Drawing Sheets

POLISHING METHOD

BACKGROUND OF THE INVENTION

The present invention relates to a method of polishing a wafer surface in a wiring process as one of processes for manufacturing a semiconductor integrated circuit, and particularly to a method of polishing a thin film layer to be polished on a wafer surface by accurately detecting the thickness of the thin film layer and feedback-controlling the polishing condition on the basis of the detected result.

A wiring process, one of a number of processes for manufacturing a semiconductor device, includes a process of planarizing a micro-topography on the surface of an insulating layer formed on a wafer surface by chemical-mechanical polishing. First, the planarization process will be described in detail with reference to FIGS. 1(*a*) to 1(*f*).

FIG. 1(*a*) shows a sectional view of a wafer on which a metal layer is formed as a first layer. An insulating film layer 2 is formed on the surface of a wafer substrate 1, and a metal layer 3 made of aluminum or the like is provided on the insulating film layer 2. A contact hole 2' is formed in the insulating layer 2 for connecting the metal layer 3 to a transistor portion, and a pit 3' is formed in the portion of the metal layer 3 corresponding to the contact hole 2'. In the next wiring process of forming a second layer, as shown in FIG. 1(B), an insulating layer 4 is formed on the metal layer 3 as the first layer, and an aluminum layer as the second layer is formed on the insulating layer 4. At this time, if being left as deposited, the insulating film layer 4 causes an inconvenience such as defocus upon exposure in the subsequent lithography process because of the micro-topography on its surface. To cope with this inconvenience, the insulating film layer 4 is polished by a manner described later up to a level shown by the dashed line 5, thus planarizing the surface of the insulating film layer 4 as shown in FIG. 1(*c*). After the surface of the insulating film layer 4 is thus planarized, a contact hole 6 is formed as shown in FIG. 1(*d*), and a wiring pattern 7 as the second layer is formed thereon as shown in FIG. 1(*e*). As shown in FIG. 1(*f*), an insulating layer 8 is then formed again, and polished up to a level shown by the dashed line 9. A multi-layer wiring is thus formed by repeating these steps.

FIG. 2 shows a polishing method for planarizing the above-described insulating film layer. A polishing pad 11 is stuck on a platen 12 and is rotated by a motor 10. On the other hand, a wafer 1 to be processed is fixed on a wafer holder 14 by way of an elastic backing pad 13. The wafer 1 is pressed on the surface of the polishing pad 11 while the wafer holder 14 is rotated. At this time, slurry 15 is supplied onto the polishing pad 11. Thus the projecting portions of the insulating layer on the surface of the wafer 1 are polished off, that is, the surface of the insulating film layer is planarized. In this case, by the use of colloidal silica suspended in a solution of potassium hydroxide as the slurry, there can be obtained a high polishing efficiency being several times or more that in the case where only a mechanical polishing action is imparted because a chemical polishing action is added to the mechanical polishing action. This process has been extensively known as a chemical-mechanical polishing method.

In the above polishing process, a problem lies in how the progress of the polishing up to a level 5 or 8 is detected, and in when the polishing should be completed, that is, in the so-called endpoint detection. Specifically, in the above polishing method, as shown in FIG. 3, the wafer 1 to be processed is put between the two elastic pads 11, 13, and accordingly, it is almost impossible to detect a change in thickness of the insulating film layer in the target level of 0.1 μm by measuring a change in the distance between these pads.

As the prior art endpoint detection technique, there has been used a method of previously examining a polishing rate and estimating a residual thickness by time control; or a method of estimating the progress of polishing by detecting a change in the rotational torque of a rotating platen on the basis of a phenomenon in which a friction force between a polishing pad and a workpiece is changed as the topography on the surface to be processed is reduced along with the progress of polishing (see the Specification of U.S. Pat. No. 5,069,002). Either of these methods, however, has a disadvantage that the detection accuracy is dependent on a change in the polishing condition.

Another prior art is disclosed in U.S. Pat. No. 5,081,421, which takes into account the fact that the insulating film layer to be processed is made of dielectric material and utilizes a phenomenon in which the capacitance of an insulating film layer is changed along with the progress of polishing. Specifically, as shown in FIG. 4, a portion 17 of a conductive metal made rotating platen 12 is insulated from the other members by means of an insulating ring 16, and an AC voltage of about 5 KHz is applied between the portion 17 and a rotating holder 14 for a wafer. In the case of where a wafer substrate 1 and a polishing pad 11 permeated with slurry are conductive, an AC current flows therebetween, and in this case, the current value is dependent on the thickness of the insulating film layer 4 to be polished. Consequently, on the basis of such a change in the current value, the thickness of the insulating film layer 4 can be detected. Even in this case, however, a change in the capacitance along with the progress of polishing is influenced not only by a change in the thickness of the insulating film layer 4 but also by the texture and density of an aluminum wiring 3 as the bottom layer, so that the detection sensitivity must be calibrated for each circuit pattern on the wafer 1.

As a process of polishing the surface of a semiconductor device to which the present invention is applied, there has been known a method of previously forming a metal thin film layer for wiring and then planarizing only projecting portions of the thin film layer. In this case, the above-described method of measuring the film thickness using a change in capacitance cannot be applied. As a method applied to this case, an impedance measurement method utilizing the conductivity of the above metal thin film layer portion is disclosed in EP-A1-0460384; however, this method is disadvantageous in that it cannot be applied to the case of polishing an insulating thin film layer.

SUMMARY OF THE INVENTION

An object of the present invention is to solve the above-described disadvantages of the prior arts, and to provide a new and original polishing method capable of polishing a film layer while accurately monitoring the residual thickness of the film layer irrespective of the kind of a circuit pattern on a wafer and the film material.

The above object can be achieved by provision of a method of polishing a film layer by detecting the residual thickness of the film layer on the surface a wafer directly and further in consideration of the film thickness of a topography portion, in place of a prior art monitoring method easier to exert an effect on a topography on the surface of the wafer, for example, a method of detecting a change in frictional force upon polishing or a method of detecting a change in capacitance.

With respect to an insulating film layer on a wafer surface to be processed, the positions of the front surface and the bottom surface are independently detected. The thickness of the insulating film layer can be thus accurately obtained on the basis of the difference between both the detected positions. On the basis of the result, the processing condition is feedback-controlled, to thus achieve the highly accurate polishing. More specifically, a fluidic micrometer as a position sensor for detecting the front surface position of the insulating film layer, and an optical focus sensor as a position sensor for detecting the bottom surface position are coaxially provided on portions of a rotating platen. With this arrangement, accurate measurement for film thickness can be performed. In the case of polishing an optically opaque metal thin film layer, accurate endpoint detection for polishing can be performed by adopting a method of measuring the residual thickness of the film layer on the basis of a refractive change on the surface of a wafer to be processed.

These and other objects and many of the attendant advantages of the invention will be readily appreciated as the same becomes better understood by reference to the following detailed description when considered in connection with the accompanying drawings.

DETAILED DESCRIPTION OF THE PREFERRED EMBODIMENTS

Hereinafter, embodiments of the present invention will be described with reference to the drawings.

Figure 1:
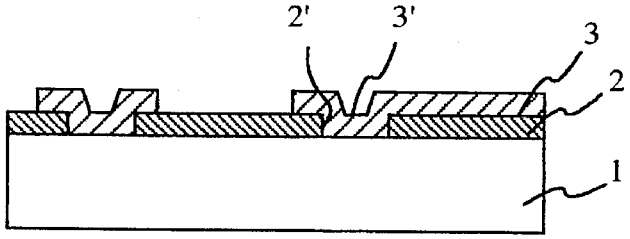
FIGS. 1(*a*) to 1(*f*) are views for illustrating a process of planarizing a wafer surface.
Figure 1:
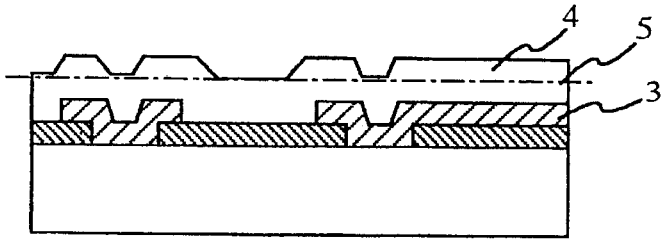
Figure 1:
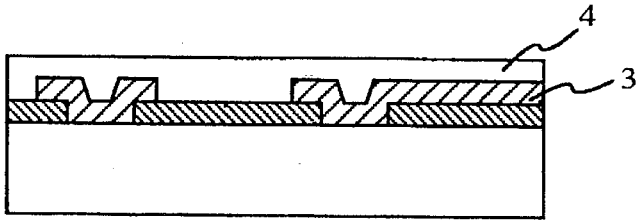
Figure 1:
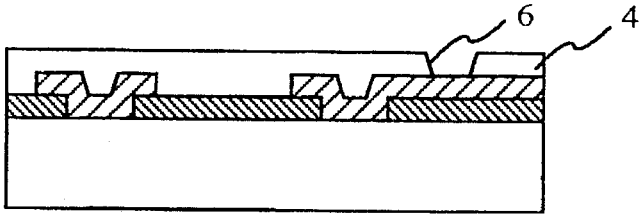
Figure 1:
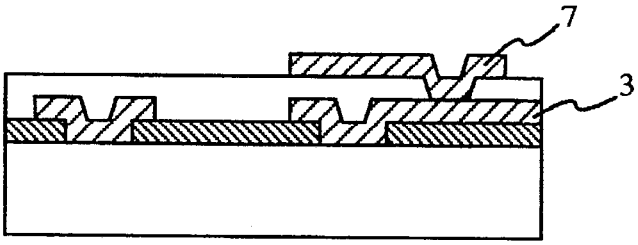
Figure 1:
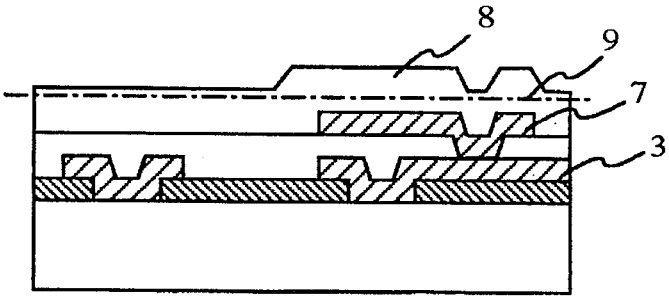
Figure 2:
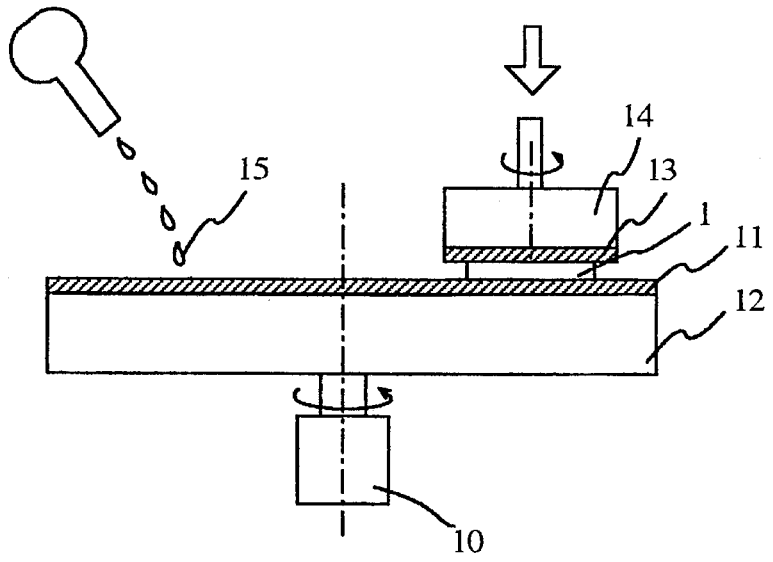
FIG. 2 is a view for illustrating a chemical-mechanical polishing method.
Figure 3:
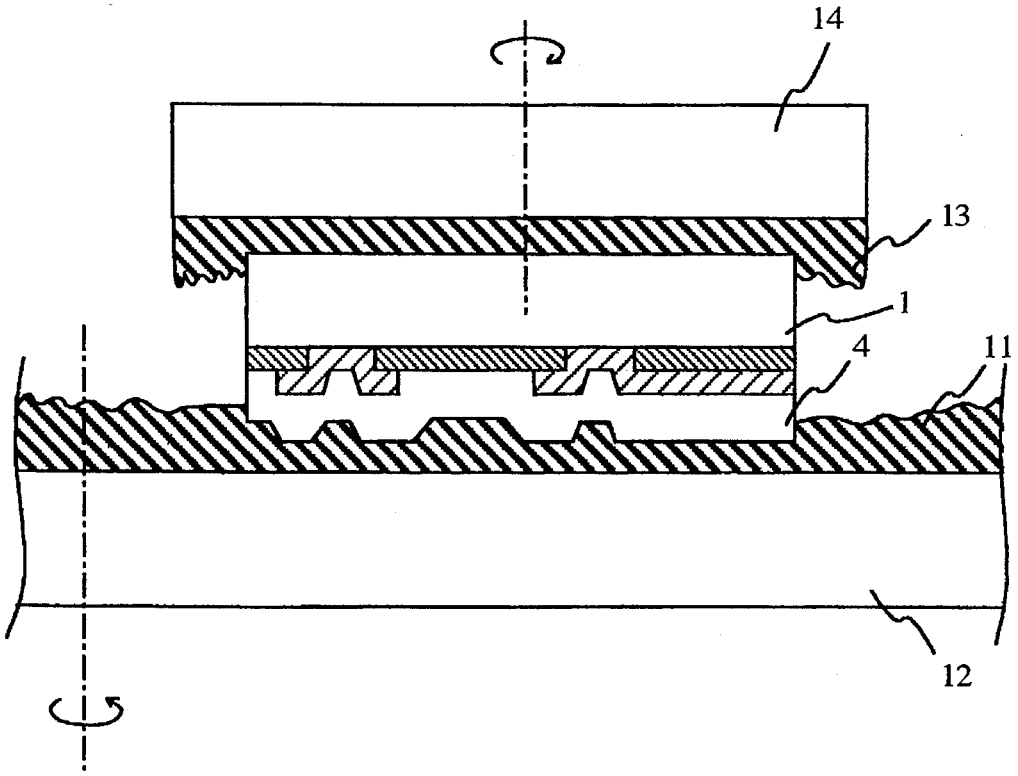
FIG. 3 is a view for illustrating a problem of the chemical-mechanical polishing method
Figure 4:
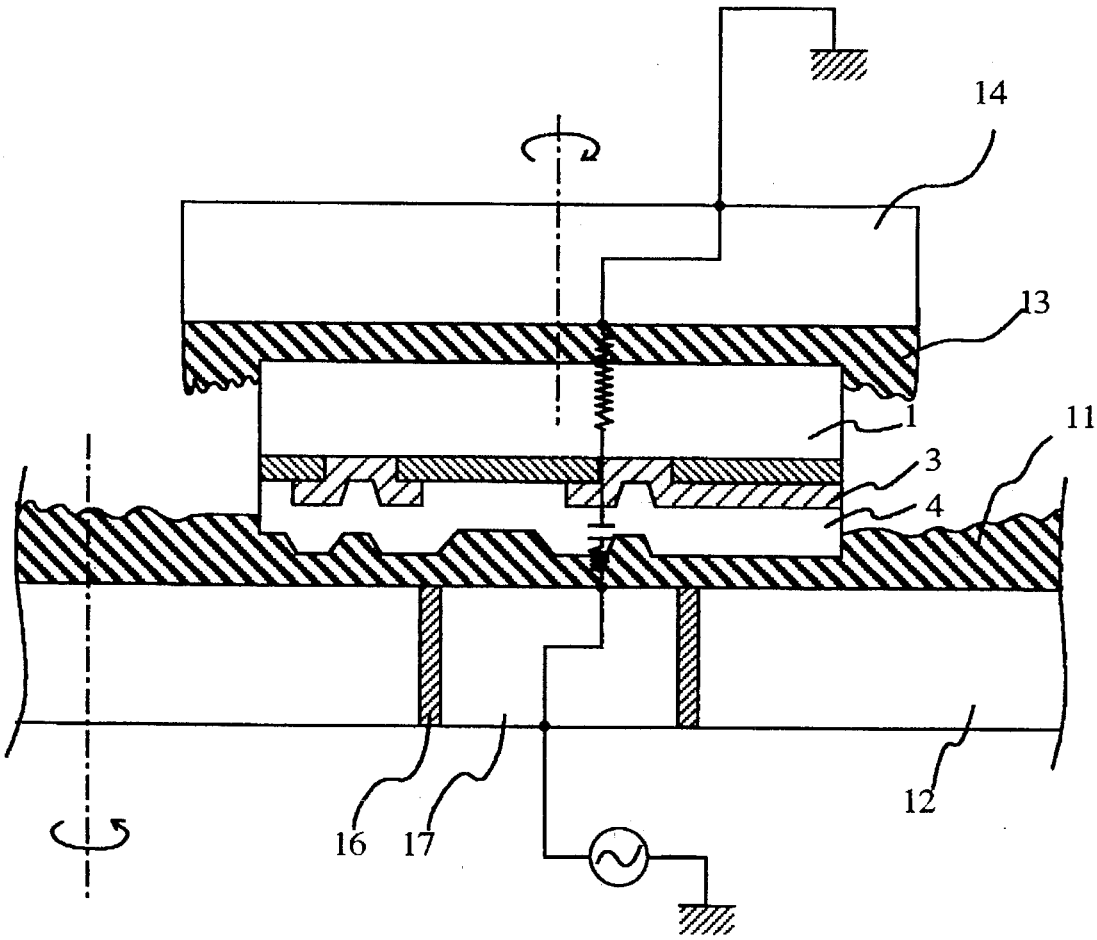
FIG.4 (PRIOR ART)
FIG. 4 is a view for illustrating one example of a prior art endpoint detection method.
Figure 5:
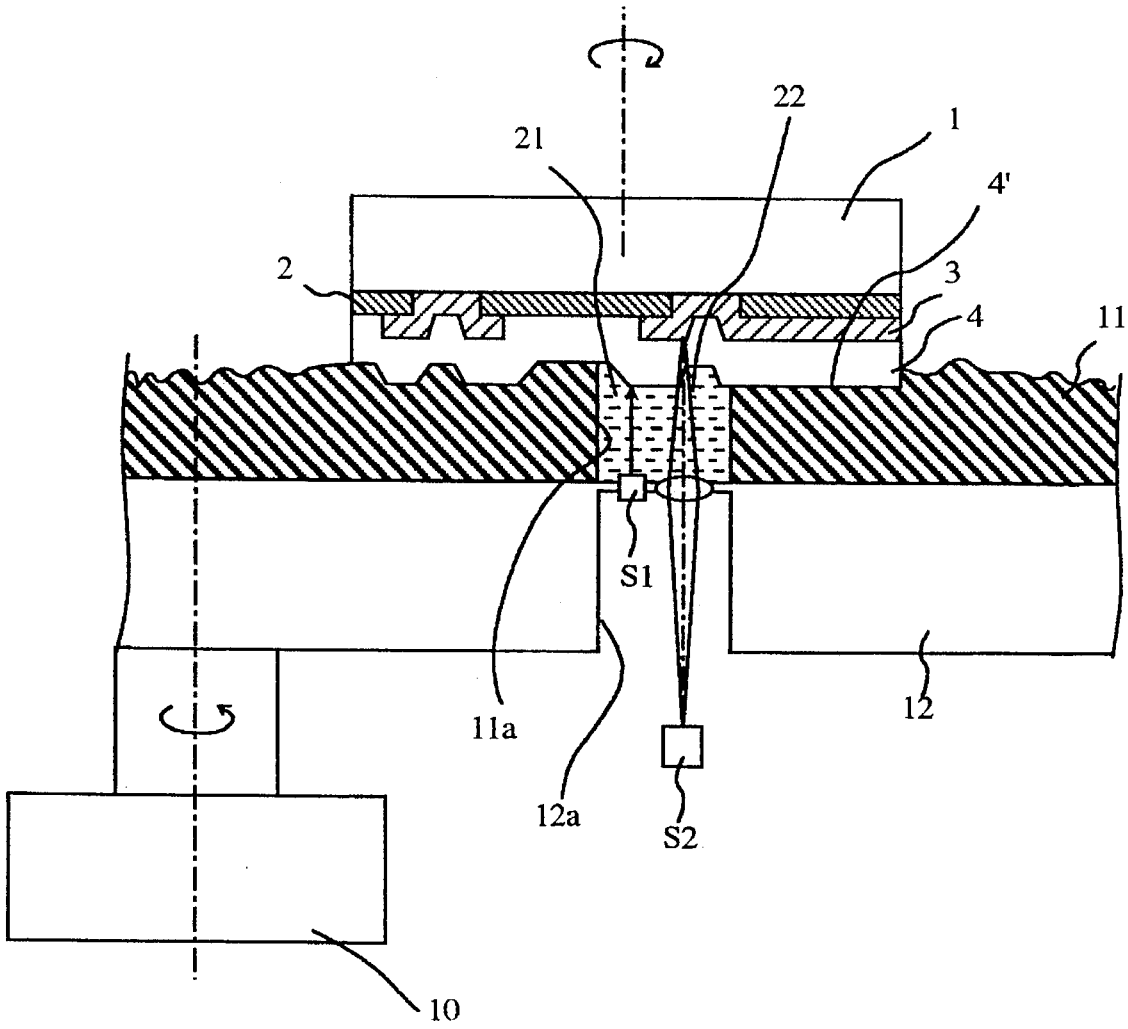
FIG. 5 is a view showing a polishing method according to one embodiment of the present invention.

FIG. 5 is a typical sectional view for illustrating a polishing method according to one embodiment of the present invention. A polishing pad 11 is stuck on a platen 12 rotated by a motor 10. A wafer 1 to be polished is pressed on the surface of the polishing pad 11 while slurry is supplied on the surface of the polishing pad 11. With this polishing, projecting portions of an insulating film layer 4 on the surface of the wafer 1 are removed, to thus planarize the surface of the insulating film layer 4. In this case, by the use of colloidal silica or the like suspended in a solution of potassium hydroxide as the slurry, there can be obtained a high removal rate being several times or more that in the case where only a mechanical polishing action is imparted because a chemical polishing action is added to the mechanical polishing action.

Figure 6:
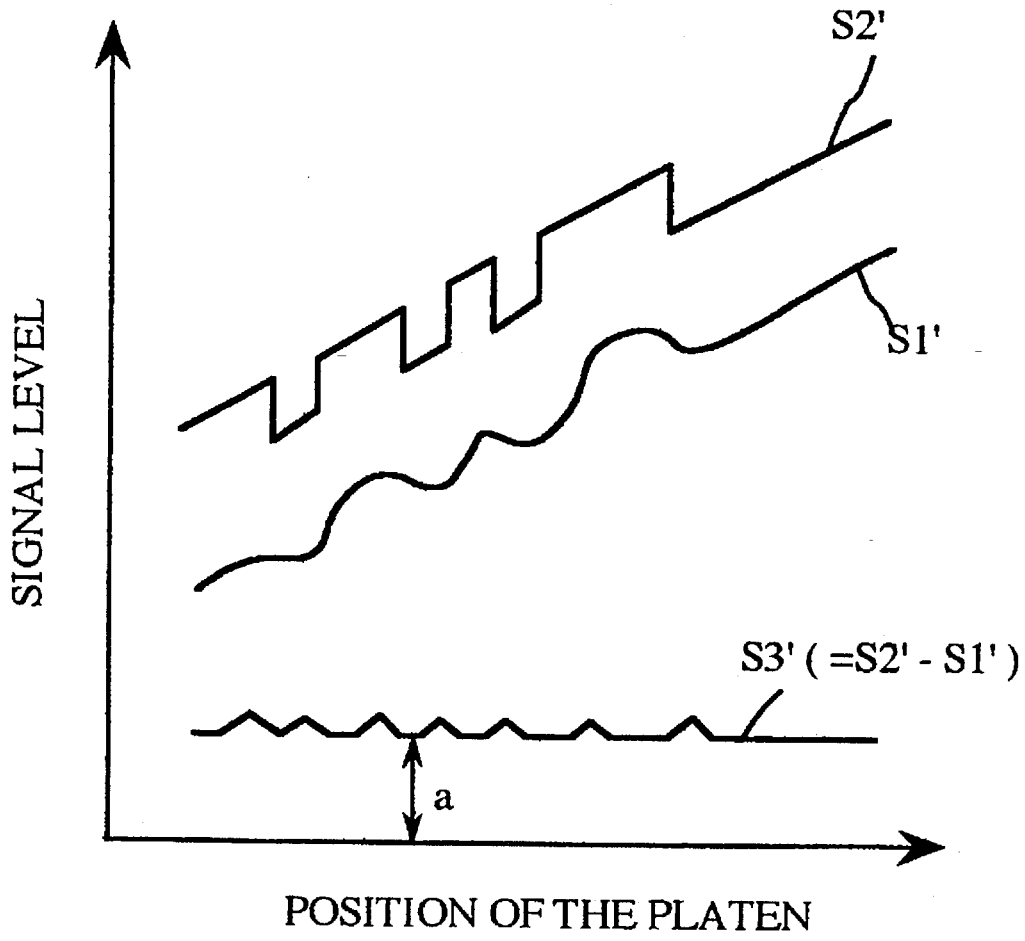
FIG. 6 is a view showing one example of a detection signal in the polishing method according to the above embodiment.

In this embodiment, openings 11*a*, 12*a* are provided on respective portions of the polishing pad 11 and the rotating platen 12, and within these openings 11*a*, 12*a*, a first sensor S1 for detecting the position of the front surface (to be polished) of the insulating film layer 4 and a second sensor (focus position sensor) S2 for optically detecting the position of the bottom surface (reflection surface on the wafer side) of the insulating film layer 4 are provided, respectively. Here, by filling the interior of the opening 11*a* of the polishing pad 11 with a fluid having an optical refractive index being substantially the same as that of the insulating film layer 4, for example, with pure water 21, an illumination beam 22 from the sensor S2 reaches the bottom surface of the insulating film layer 4, and is reflected from the surface of an aluminum film layer 3 or an insulating film layer 2. In such a state, an output signal from the position sensor S2 is observed while a relative motion (for example, rotation of the rotating platen 12) is imparted between the above illumination beam 22 and the insulating film layer 4, so that a micro-topography of the aluminum wiring pattern portion 3 can be detected as shown by, for example, a signal S2' in FIG. 6. On the other hand, an output signal from the sensor S1 for detecting a distance between the sensor S1 and the front surface (polishing surface)4' of the insulating film layer 4 is changed as shown by a signal S1' in FIG. 6. Here, the short-period level changes in both the signals S1', S2' are due to the topography on the surface of the wiring pattern 3, while the long-period level changes in both the signals S1', S2' (which indicate the whole gradients of both the signals) are due to a change in thickness of the polishing pad 11. Accordingly, a differential signal S3' changed depending on only the presence or absence of the wiring pattern can be obtained as a difference between the signals S2' and S1', and on the basis of the magnitude of a portion "a" of the differential signal S3', a minimum residual thickness of the insulating film layer 4 can be obtained. Based on such a result, a period of time required for the subsequent polishing can be accurately estimated.

Figure 13:
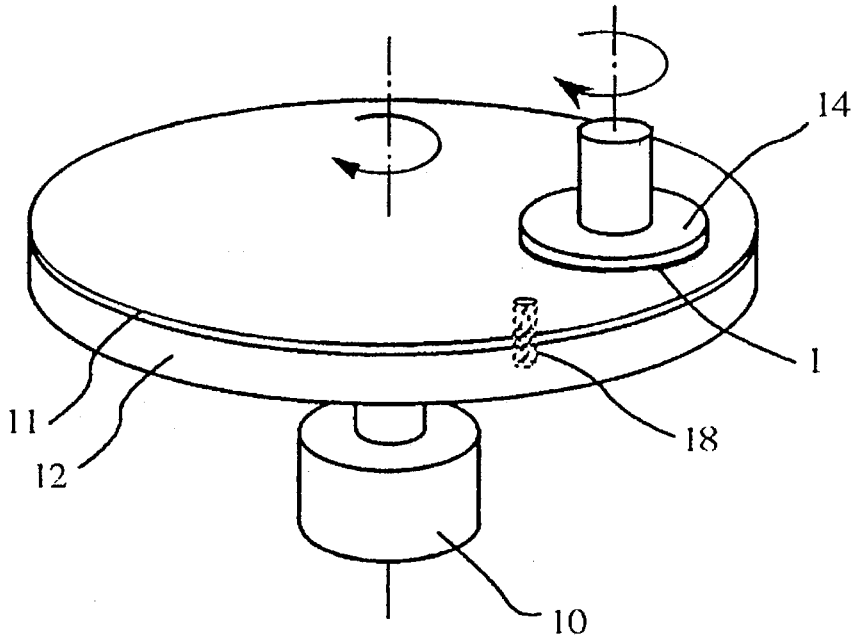
FIG. 13 is a perspective view for illustrating the embodiment shown in FIG. 5.
Figure 14:
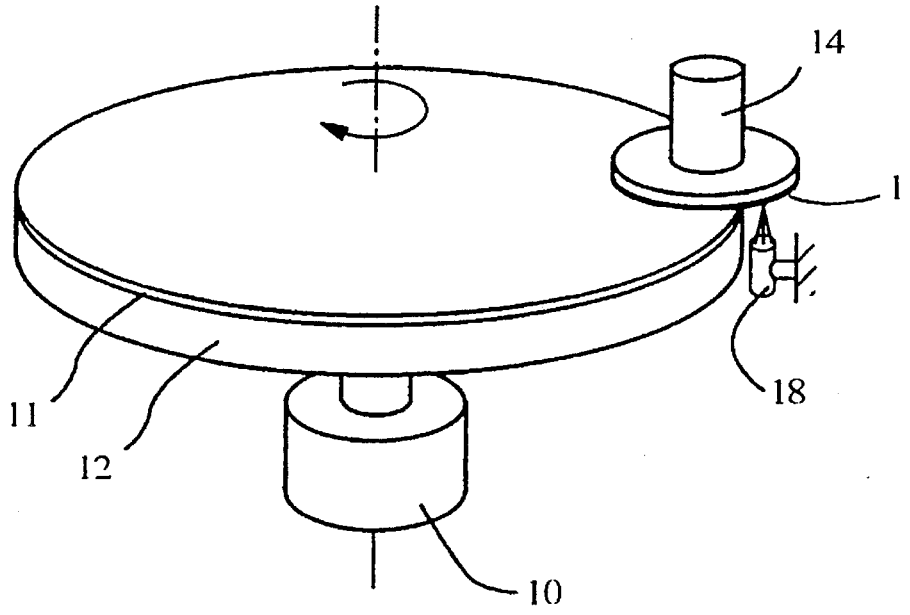
FIG. 14 is a perspective view for illustrating one modification of the embodiment shown in FIG. 5.

Since a detection head 18 in which the two sensors S1, S2 are assembled is provided on the rotating platen 12 as shown in FIG. 13, the thickness of the insulating film layer on the surface of the wafer to be processed is intermittently measured for each rotation of the rotating platen 12; nevertheless, such a measurement is justified in practical use. Additionally, in the case where the detection head 18 is provided on the rotating platen 12, supply of electrical signal and pure water must be performed through a special rotary feed joint, which complicates the construction of the apparatus somewhat. To avoid this problem, for example, as shown in FIG. 13, the detection head portion 18 is fixed on a stationary base positioned around the outer periphery of the rotating platen 12, and for monitoring the thickness of the insulating film layer on the wafer 1, the measurement may be performed in the state that the wafer 1 is protruded sideward from the outer periphery of the rotating platen 12.

Figure 7:
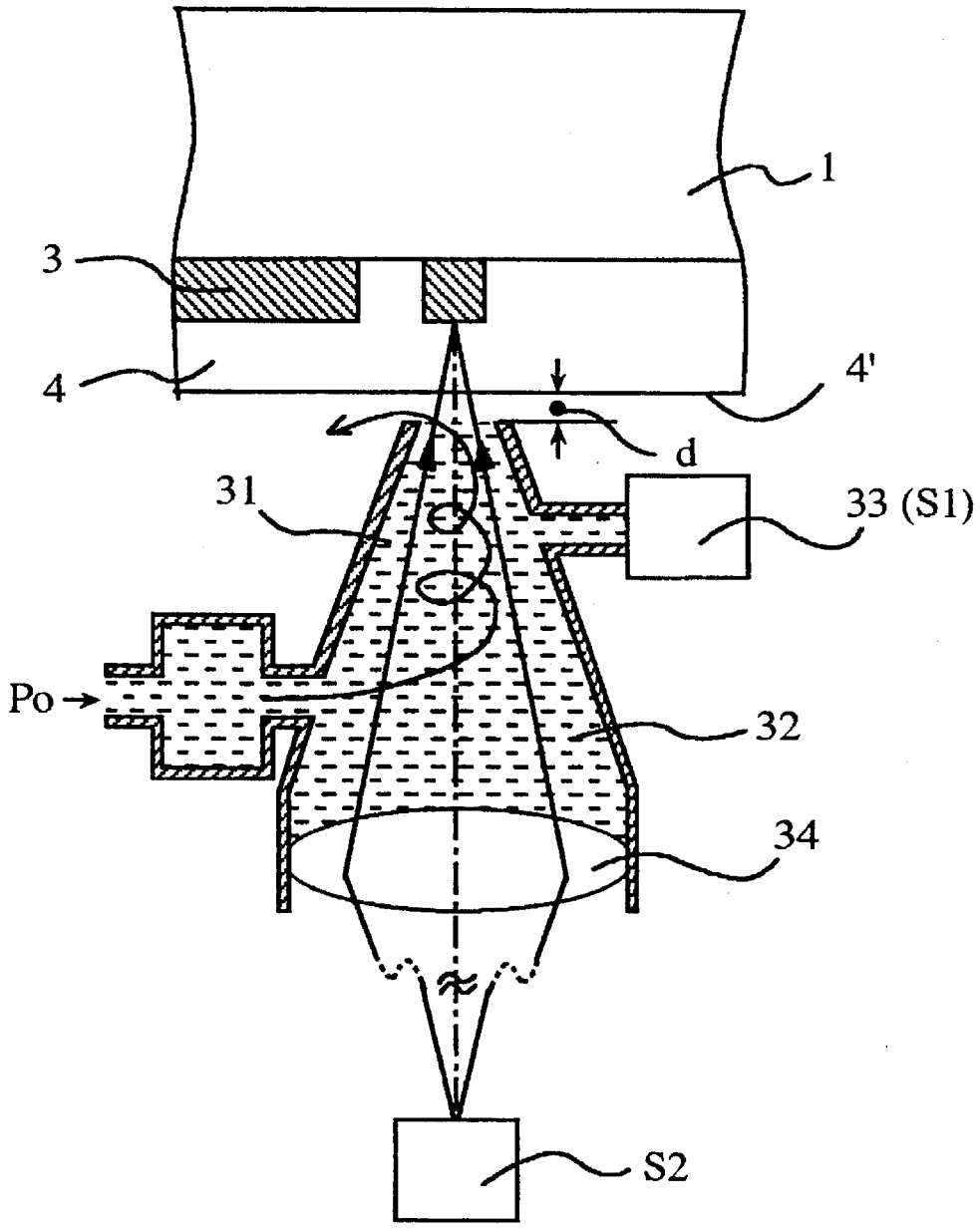
FIG. 7 is a view showing the construction of a first sensor S1 using a fluidic micrometer.

FIG. 7 shows the detail construction of the first sensor S1. The sensor is basically constituted of a fluidic micrometer. Slurry 32 is supplied into a nozzle 31 at a specified pressure Po, and an opening portion at the leading edge of the nozzle 31 is disposed to be close to a wafer surface 4' to be detected. On the other hand, the back pressure in the nozzle 31 is detected by a pressure sensor 33. With this construction, since an output signal from the pressure sensor 33 is dependent on a gap length "d" between the leading end portion of the nozzle 31 and the polishing surface 4' of the insulating film layer 4, the position of the polishing surface 4' of the insulating film layer relative to the leading end portion of the nozzle 33 can be detected on the basis of the output signal from the pressure sensor 33. In this embodiment, the other end portion of the nozzle 33 is advantageously sealed be means of an optical lens used for the second sensor S2.

Figure 8:
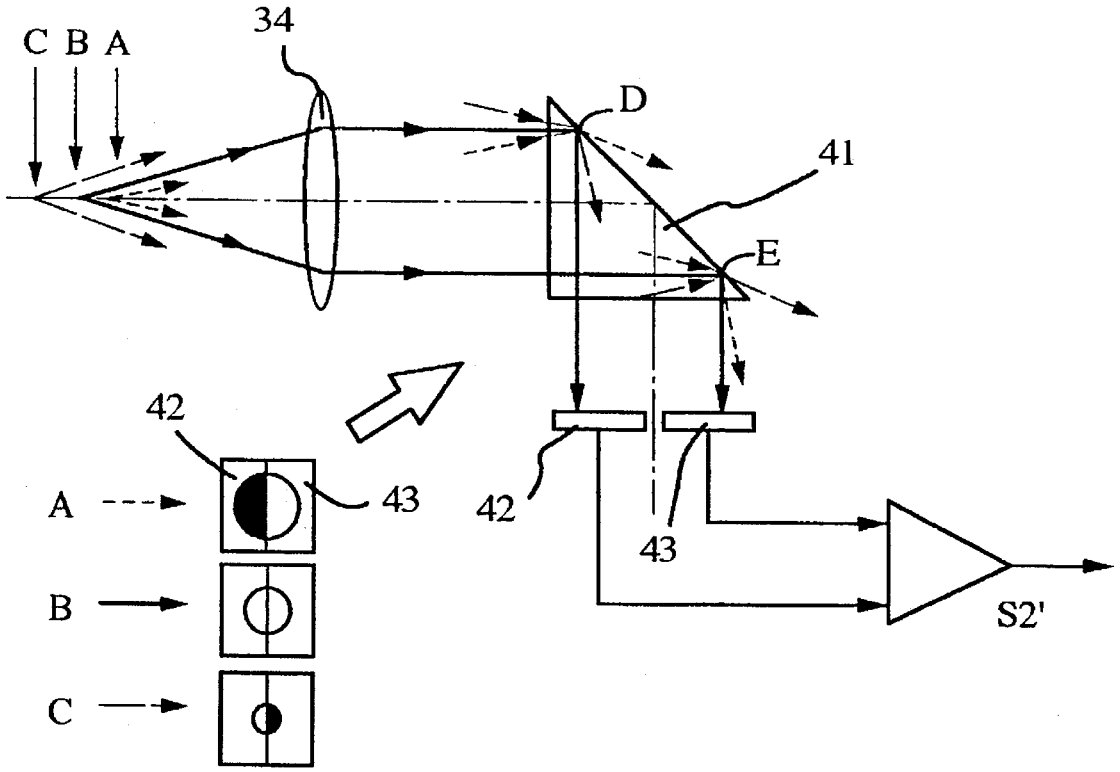
FIG. 8 is a view showing the construction of a second sensor S2 using a reflective critical angle system.

As the second sensor S2, there can be used a detection system adopted for a focus sensor of an optical pickup applicable for an optical disk or the like. Here, one example using a reflective critical angle type focus detection system used for an optical pickup will be described with reference FIG. 8. In the case where a reflection surface (bottom surface of an insulating film layer to be detected=wiring pattern surface) is present at a B point (on-focal position in an optical system) in the figure, the reflection rays of light from the reflection surface pass through an objective lens 34 and are made in the parallel rays of light, as a result of which in a critical angle prism 41 the reflectance at a D point is equal to that at an E point, and thereby the quantities of rays of light coming in optical sensors 42, 43 are made equal to each other. Hence, the differential signal S2' between the detection signals from both the optical sensors becomes just zero. On the other hand, in the case where the reflection surface is present at an A point in the figure, the reflection rays of light reflected from the reflection surface pass through the objective lens 34 and are spread, as a result of which in the critical angle prism 41 the reflective index at the D point is decreased while the reflective index at the E point is increased. Hence, the detection signal from the optical sensor 43 is larger than that from the optical sensor 42, and thereby the differential signal S2' becomes positive. On the contrary, in the case where the reflection surface is present at a C point in the figure, the reflection ray of light after passing through the objective lens 34 are concentrated, as a result of which the reflective index at the D point is increased while the reflective index at the E point is decreased. Hence, the detection signal from the optical sensor 42 is larger than that from the optical sensor 43, and thereby the differential signal S2' becomes negative. Accordingly, on the basis of the polarity of the differential signal S2', it can be detected that the reflection surface is positioned on which side relative to the on-focal position (B point). On the basis of such a principle, the position of the reflection surface can be detected at a resolution in the order of 0.01 μm. As a result, this focus detection system is most preferable for the sensor S2 of the present invention. Other than such a reflective critical angle system, an astigmatic imaging system, bi-prism system or the like used for a focus sensor of an optical pickup can be of course applicable for detection of the position of a reflection surface (bottom surface of an insulating film layer) according to the present invention.

In the above-described detection of the position of the reflection surface using the optical pickup system, the detection sensitivity is varied depending on a change in the reflective index of the reflection surface to be detected; however, the variation in the detection sensitivity depending on the reflective index can be corrected by detecting the reflective index of the detection portion using the sum of the signals from both the optical sensors 42, 43, thereby servo-controlling the intensity of laser light from a light source.

Figure 9:
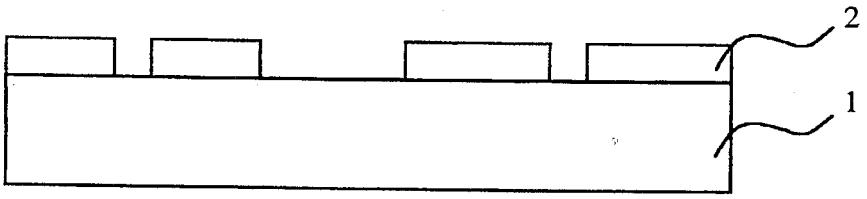
FIGS. 9(*a*) to 9(*c*) are views for illustrating a process of polishing metal damascene process.
Figure 9:
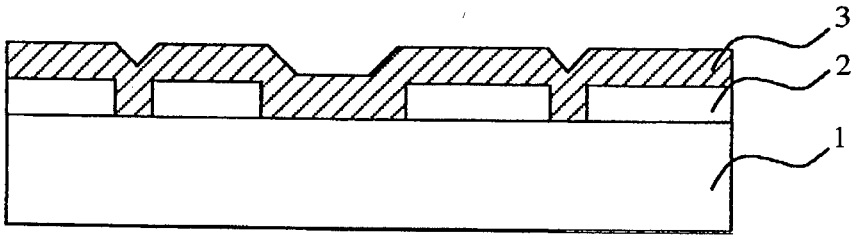
Figure 9:
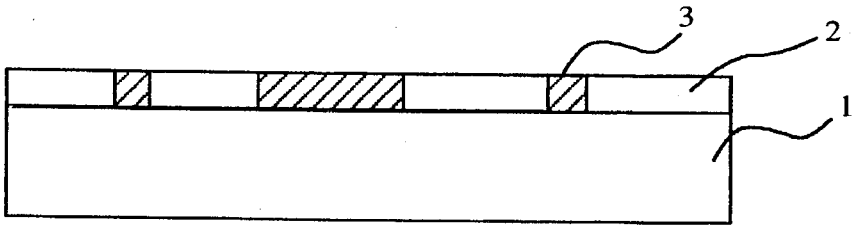
Figure 10:
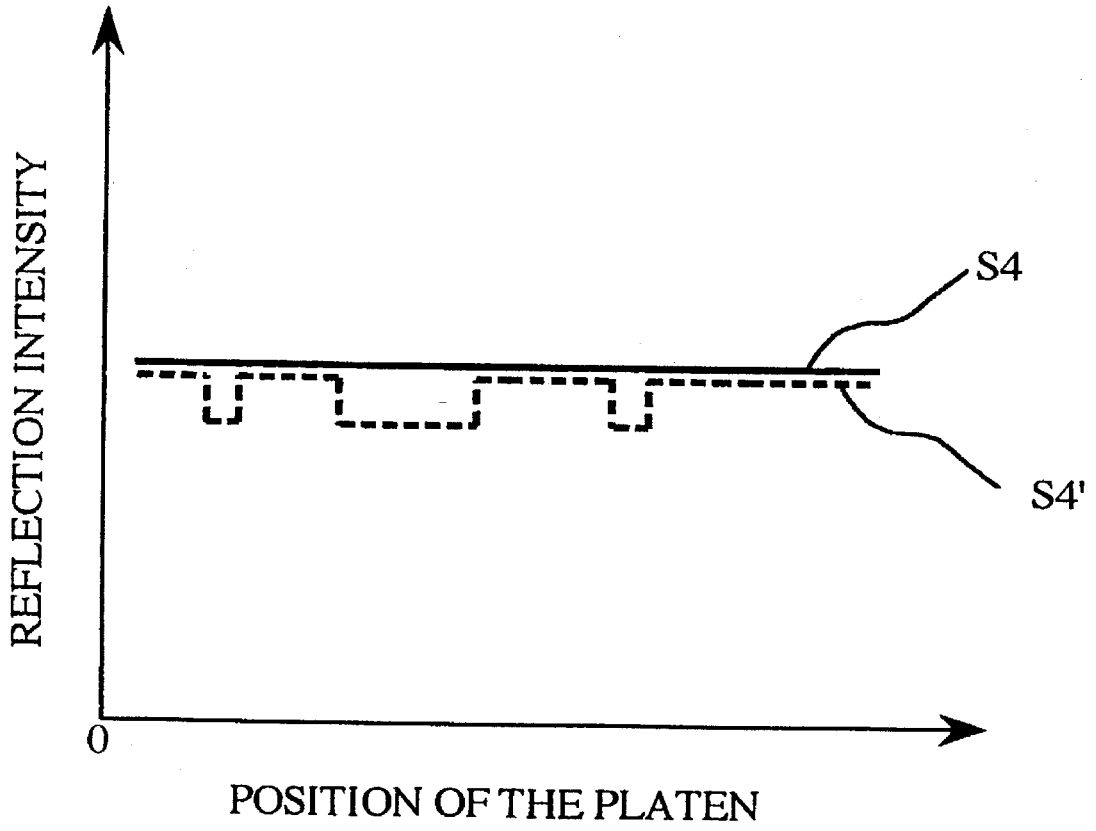
FIG. 10 is a view showing one example of a detection signal of reflective change upon polishing a metal thin film layer.

Even in the case where an optically opaque metal thin film layer or the like is polished, the polishing state can be monitored by detecting a change in the reflective index of the reflection surface to be detected. As one example of such a polishing process, a metal damascene process in manufacturing of a semiconductor device is shown in FIGS. 9(*a*) to 9(*c*). In this polishing process, an insulating film layer 2 is previously formed on a wafer substrate 1, followed by patterning, and a metal film layer 3 made of, for example aluminum as a wiring material is deposited on the insulating film layer 2, after which projecting portions on the surface of the metal film layer 3 are polished. The polishing is completed at the stage where the insulating film layer 2 is exposed from the surface. The endpoint in the polishing of the metal film layer 3 cannot be detected by the above-described method because the metal film layer 3 is generally optically opaque. To cope with this problem, a change in the reflective index on the polishing surface is monitored using a reflective index measuring function of the reflection surface position sensor of an optical pickup system as the above-described second sensor S2. In this case, as shown in FIG. 10, at the initial stage of polishing, a signal S4 usually indicating a high refractive index is obtained because the whole polishing surface is covered with the metal film layer; however, in the stage where the insulating film layer 2 is exposed from the surface along with the progress of polishing, a change in the reflective index corresponding to the portion of the insulating film layer having a low reflective index, as shown by the signal S4', is generated. On the basis of a change of the reflective index, a time when the polishing should be completed can be estimated.

Figure 11:
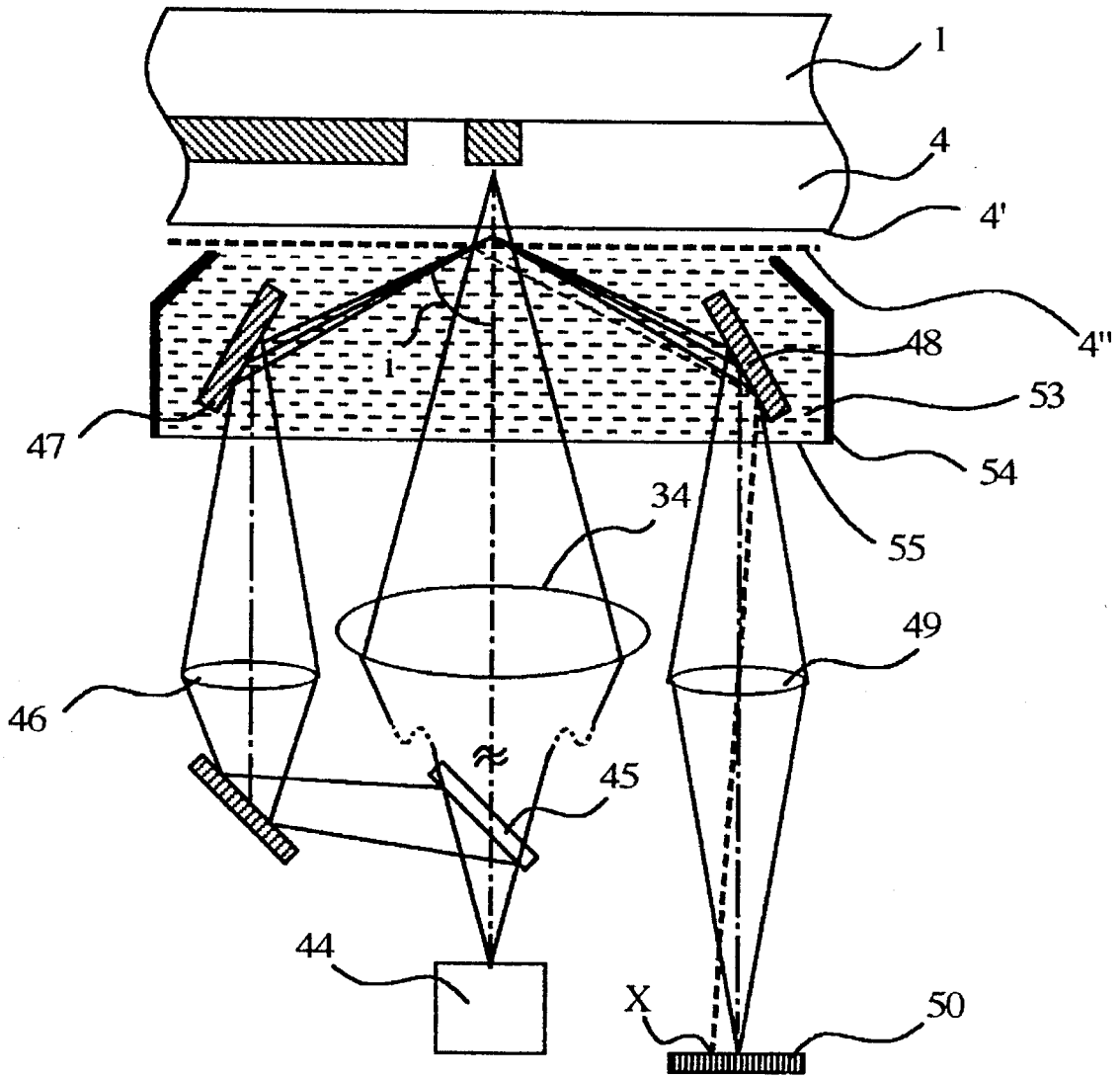
FIG. 11 is a view showing the construction of a first sensor S1 using an optical detection system.

As the first sensor S1, an optical sensor may be used in place of the above-described fluidic micrometer. The construction of the sensor S1 of this type is shown in FIG. 11. Here, a laser beam from a light source 44 of the reflection surface position sensor of an optical pickup system as the second sensor S2 is split by a beam splitter 45, and the split laser beam is focussed on the surface to be processed by way of a lens 46 and a bent mirror 47. In this case, the incident laser beam is reflected from the surface 4' of the thin film layer to be processed by setting an incidental angle "i" to be larger than a reflective critical angle determined by the refractive index ratio between the thin film layer 4 to be processed and pure water 53. The reflected light is image-formed on a line sensor 50 by way of a bent mirror 48 and a lens 49. A nozzle 54 provided with an optical window 55 is provided at the leading end portion of the optical system for filling the surface 4' of the thin film layer with pure water.

In the above optical system, when the position of the surface 4' to be processed is changed as shown by the dotted line 4" in the figure, the incident position of the reflection light to the line sensor 50 is changed as shown by the character "x" in the figure, so that the positional change of the surface 4' to be processed can be detected by monitoring an output signal of the line sensor 50. Such a detection optical system is of the so-called triangulation type; however, it is easily understood that a grazing angle interferometer using the surface to be processed as the reflection surface, and the like may be used as the above detection optical system.

Figure 12:
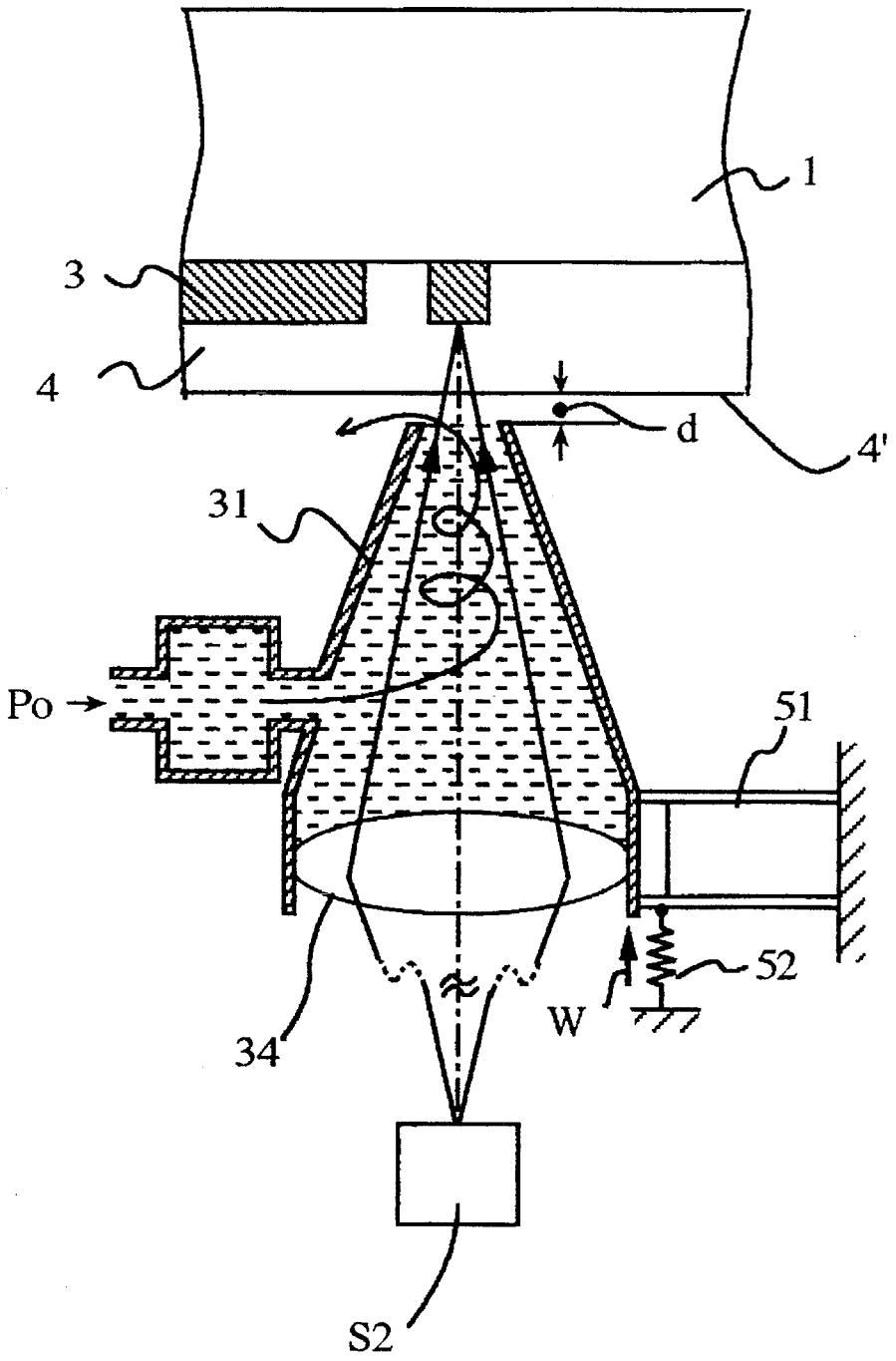
FIG. 12 is a view showing a polishing method according to another embodiment of the present invention.

Although the two sensors S1, S2 are used in this embodiment, the first sensor S1 can be omitted as shown in FIG. 12. In this case, an optical system of the second sensor S2 is automatically suspended in such a manner as to be usually floated from the polishing surface 4' by a specified distance "d" using a hydrostatic bearing in place of the fluidic micrometer as the first sensor S1. For this purpose, a nozzle portion 31 for holding the optical system is movably supported by a parallel leaf spring 51 and is usually pressed at a specified weight W in the direction of the polishing surface 4' by a spring 52, while a fluid is introduced at a specified pressure Po in the nozzle portion 31. By provision of the optical system of the second sensor S2 on the nozzle portion 31 kept to be floated from the polishing surface 4' by the specified distance "d", a change in thickness of the insulating film layer can be detected only by a detection signal of the second sensor S2.

It may be considered that a simple contact probe is used in place of the above-described hydrostatic bearing and it is pressed on the surface 4' to be processed for holding a distance between an optical lens system of the sensor S2 and the surface 4' to be processed. In this case, the above probe is slid along the surface 4' to be processed, and accordingly, the surface to be processed must be prevented from being damaged by coating a lubricating film made of such as Teflon on the sliding surface of the probe.

It is easily understood that various systems may be applicable for the sensors S1, S2, other than the above-described embodiment and its modifications. Moreover, it is apparent that the polishing method of the present invention is applicable for an SOI wafer, crystal thin film and the like, other than a semiconductor wafer described in the embodiment.

As described above, in the present invention, a film layer on the surface of a wafer can be processed by detecting the residual thickness of the film layer directly and further in consideration of the film thickness of a topography portion on the surface of the wafer, in place of a prior art monitoring method easier to exert an effect on a topography within a workpiece, for example, a method of detecting a change in frictional force upon polishing or a method of detecting a change in capacitance. This enables highly accurate polishing irrespective of the kind of a circuit pattern and the film material.

It is further understood by those skilled in the art that the foregoing description is a preferred embodiment of the disclosed device and that various changes and modifications may be made in the invention without departing from the sprint and scope thereof.

What is claimed is:

1. A method of polishing a thin film layer to be polished, which is formed on the surface of a substrate, by pressing said substrate on the surface of a polishing pad and relatively moving said substrate and said polishing pad, said method comprising the steps of:

detecting the position of a front surface of said thin film layer to be polished using a first sensor and also detecting the position of a bottom surface of said thin film layer using a second sensor, on the way of said polishing;

calculating the residual thickness of said thin film layer on the basis of the detected positions of the front and bottom surfaces of said thin film layer; and controlling the processing condition of the subsequent polishing on the basis of the calculated residual thickness of said thin film layer.

2. A polishing method according to claim 1, wherein said first sensor and said second sensor are provided on the side of said polishing pad in such a manner as to face to the surface of said substrate, and the front and bottom surfaces of said thin film layer are respectively detected as the distances from said first and second sensors to the front and bottom surfaces of said thin film layer.

3. A polishing method according to claim 2, wherein said second sensor has a detective resolution capable of detecting a topography on the bottom surface of said thin film layer.

4. A polishing method according to claim 2, wherein said residual thickness of said thin film layer is obtained on the basis of a differential signal between a second detection signal and a first detection signal, said second detection signal being obtained by said second sensor so as to correspond to the distance from said second sensor to the position of the bottom surface of said thin film layer, and said first detection signal being obtained by said first sensor so as to correspond to the distance from said first sensor to the position of the front surface of said thin film layer.

5. A polishing method according to claim 2, wherein said second sensor is of a type of illuminating and image-forming light on the bottom surface of said thin film layer in a spot shape, and on the basis of the optical information contained in the light reflected from the portion where the light is illuminated in the spot-shape, detecting the distance from said second sensor to the bottom surface of said thin film layer.

6. A polishing method according to claim 2, wherein said first and second sensors are fixed on a platen for supporting said polishing pad.

7. A polishing method according to claim 2, wherein said first sensor is a fluidic micrometer.

8. A polishing method according to claim 7, wherein an operating fluid in said fluidic micrometer is the same fluid as slurry used for polishing said thin film layer.

9. A polishing method according to claim 2, wherein said first sensor is of a type of illuminating light on the surface of said thin film layer at an angle larger than a critical reflection angle determined by refractive indexes of said thin film layer and said slurry, and on the basis of the optical information contained in the light reflected from said surface of said thin film layer, detecting the distance from said first sensor to the front surface of said thin film layer.

10. A method of polishing a thin film layer to be polished, which is formed on the surface of a substrate, by pressing said substrate on the surface of a polishing pad and relatively moving said substrate and said polishing pad. said method comprising the steps of:

directly detecting the distance from the position of a front surface of said thin film layer to be polished to the position of a bottom surface of said thin film layer using a sensor on the way of said polishing;

calculating the residual thickness of said thin film layer on the basis of said detected distance; and controlling the processing condition of the subsequent polishing on the basis of the calculated residual thickness of said thin film layer;

wherein said sensor is provided on the side of said polishing pad in such a manner as to face the surface of said substrate, and the distance between the positions of the front and bottom surfaces of said thin film layer is directly detected as a differential value between the distance from said detector to the front surface of said thin film layer and the distance from said detector to the bottom surface of said thin film layer.

11. A polishing method according to claim 10, wherein said detector is of a type of illuminating and image-forming light on the bottom surface of said thin film layer in a spot-shape, and on the optical information contained in the light reflected from the portion where the light is illuminated in the spot-shape, detecting a differential value between the distance from said detector to the front surface of said thin film layer and the distance from said detector to the bottom surface of said thin film layer.

12. A polishing method according to claim 10, wherein said detector has a detective resolution capable of detecting a topography of the bottom surface of said thin film layer.

13. A polishing method according to claim 10, wherein said sensor has a function of detecting a reflective index of the bottom surface of said thin film layer.

* * * * *